XR 4,370,197

United States Patent [19]

Abolafia et al.

[11] 4,370,197

[45] Jan. 25, 1983

[54] PROCESS FOR ETCHING CHROME

[75] Inventors: Oscar R. Abolafia, Endwell; Joseph G. Ameen, Apalachin; Glenn V. Elmore, Vestal, all of N.Y.

[73] Assignee: International Business Machines Corporation, Armonk, N.Y.

[21] Appl. No.: 276,723

[22] Filed: Jun. 24, 1981

[51] Int. Cl.[3] ..... C23F 1/02

[52] U.S. Cl. ..... 156/659.1; 156/656; 156/664; 252/79.4; 252/149

[58] Field of Search ..... 252/79.4, 142, 149; 134/3, 41; 156/664, 656, 659.1, 666, 650–652; 430/313, 318, 323; 75/97 R, 121

[56] References Cited

U.S. PATENT DOCUMENTS

| | | | |
|---|---|---|---|
| 2,746,848 | 5/1956 | Jones | 156/664 X |
| 2,959,555 | 11/1960 | Martin et al. | 252/149 |
| 3,181,984 | 5/1965 | Tillis | 156/664 |
| 3,353,995 | 11/1967 | Teumac | 134/3 |
| 3,539,408 | 11/1970 | Cashau et al. | 252/79.2 X |
| 3,636,123 | 8/1972 | Hiroshi | 252/87 |
| 3,668,131 | 6/1972 | Banush et al. | 252/79.4 |
| 3,701,698 | 10/1972 | Forestek | 252/79.2 X |
| 3,778,309 | 12/1973 | Jackson | 134/2 |
| 4,196,062 | 4/1980 | Barclay et al. | 204/36 |

FOREIGN PATENT DOCUMENTS

| | | | |
|---|---|---|---|
| 162986 | 6/1953 | Australia | 252/79.4 |
| 413227 | 5/1974 | U.S.S.R. | 252/79.4 |

*Primary Examiner*—William A. Powell

*Attorney, Agent, or Firm*—Pollock, Vande Sande & Priddy

[57] ABSTRACT

An aqueous acidic composition suitable for etching which contains an acid and a thiourea compound, and use thereof.

23 Claims, No Drawings

PROCESS FOR ETCHING CHROME

1. Technical Field

The present invention is concerned with compositions suitable for use as etchants and the use thereof. The compositions are especially suitable for etching chrome. In particular, the present invention is concerned with improved acidic etching compositions. The compositions of the present invention are especially applicable in etching chrome circuitry lines for integrated circuit chips.

2. Background Art

The manufacture of integrated circuit electronic packages involves the interconnection between the integrated circuit carrier or substrate and the integrated semiconductor device or chip. Many commercial integrated circuit carriers are fabricated by applying to a ceramic substrate or carrier, a chrome layer, followed by a copper layer, followed by another chrome layer. Also, sometimes a cermet layer is placed between the ceramic substrate and bottom chrome layer. Next, a photoresist composition is applied so that selected areas of the chrome/copper/chrome/cermet layers can be removed to provide the desired electrical connections on the substrate.

The top chrome layer is present so that subsequently applied solder will not adhere to the substrate in those areas where the chrome remains. The copper layer provides electrical conductivity. The bottom chrome layer is applied to insure adequate adhesion between the copper and the cermet. The cermet in conjunction with subsequently applied metal acts as a resistor in the final product.

The etching of the chrome layers has been carried out employing etchant compositions having high pH, such as aqueous compositions containing $KMnO_4$. The use of aqueous etchant compositions having high pH is not entirely satisfactory, since $KMnO_4$ tends to attack the cermet to some extent as well as the chrome layers Moreover, the use of aqueous etchants which are highly basic has resulted in the use of negative photoresists for defining the particular circuitry involved. Commercially available positive photoresist materials such as those based on phenolic-formaldehyde novalak polymers are not resistant to the highly basic etchant compositions employed to etch the chrome, and, accordingly will not protect the areas which are needed to be etched.

The ability to employ a positive photoresist would be quite advantageous for a number of reasons. For instance, a positive resist is less sensitive to dirt or other contaminants than is a negative photoresist, since only the exposed areas of a positive photoresist are developed and are etched away. Accordingly, if dirt or some other contaminant is present, it will remain on the unexposed portions; thus, it will not play a significant part in regard to formation of defects. On the other hand, with a negative photoresist, the exposed areas are cured and the unexposed areas are etched away.

In addition, the ability to use a positive photoresist makes it possible to employ a single coating to prepare several different circuits by exposing, developing and etching the required surface and then repeating the steps as many times as needed. Furthermore, positive resists provide sharper image resolution as compared to negative resists, since the desired image does not swell and, thereby, remains unchanged during the development with the particular solvent. In addition, the unexposed positive photoresist can be readily removed when desired, such as by simple chemical solvents including N-methyl-2-pyrrolidone for many commercially available positive resists and/or reexposed to suitable light and then removed with the same solution employed to develop the circuitry.

However, the various commercially available positive photoresists, such as the methacrylate polymers, necessitate an etchant for the underlying chrome which is on the acidic side. Although certain acidic etchants have been suggested for chrome, such are not entirely satisfactory. For instance, the etching with various prior acidic etchants is very slow at the start but then accelerates very rapidly forming or generating relatively large amounts of gas which are uncontrollable and cause the formation of bubbles. This is not suitable, especially for fine line circuitry. Moreover, sometimes the chrome surface is not even etched at all in such acidic etchants which may be possibly due to passivation of the chrome surface.

It has previously been found that mixtures of glycols and dilute HCl etch chromium at ambient temperatures. However, when etching the lower chromium layer, the exposed edges of the top chromium layer etch during the relatively longer times needed to etch the lower layer so that undercutting of the top layer occurs. This in turn results in a portion of the copper being exposed at the top edges and ends of the conductor lines. When the structure is tinned, the copper is wetted by the solder in those exposed areas and solder bridges can form over the resistors and between the conductor lines, which render the structure inoperative.

It has also been found that a concentrated HCl mixture of about 50% by volume or more provides an etch time for the lower chromium layer which sufficiently minimizes the undercutting of the top chromium layer; however, these concentrated mixtures attack the cermet and cause unacceptable changes in its resistivity.

These problems of undercutting of the top chromium layer and changes in the resistivity of the cermet have been minimized by employing the invention disclosed in U.S. Pat. No. 4,160,691 to Abolafia, et al wherein certain concentrated HCl compositions are employed at temperatures from about 50° to about 95° C. Although, the invention disclosed and described in U.S. Pat. No. 4,160,691 does in fact minimize the undercutting of the top chromium layer and the changes in resistivity of the cermet experienced by other acidic compositions, such is still not entirely satisfactory. The compositions could stand improvement with respect to pH stability during use and over long periods of time and could stand improvement with respect to storage stability over relatively long periods of time.

DISCLOSURE OF INVENTION

The present invention provides an etchant composition which is acidic and which is capable of etching chrome in a controllable and quick manner. In addition, the present invention makes it possible to etch chrome whereby the advantages of minimizing the undercutting of the top chromium layer and changes in resistivity of the cermet as achieved by the invention of U.S. Pat. No. 4,160,691 are retained as well as achieving a much greater stability of the composition. The compositions of the present invention are pH stable during use and over long periods of time and can be stored without a detrimental effect to the composition for relatively long periods of time. Also, with the etchant compositions of the present invention, bubble formation is substantially, if not entirely, eliminated. Moreover, excellent resolution is achieved with the etchant compositions of the present invention. The present invention also makes it possible to employ positive photoresists which are commercially available, since such are resistant to the etchant compositions of the present invention. Moreover, the present invention provides for uniform etching of the chromium.

In particular, the present invention is concerned with a method for etching chrome which comprises contacting the chrome with an acidic etchant composition which contains water, an inorganic acid, and thiourea and/or a substituted thiourea. Moreover, the present invention is concerned with certain preferred compositions which consist essentially of water, about 8 to about 10% by weight of sulphuric acid, and about 1 to about 10% by weight of thiourea and/or substituted thiourea.

DESCRIPTION OF BEST AND VARIOUS MODES FOR CARRYING OUT INVENTION

The acidic aqueous compositions of the present invention contain an inorganic acid. The acid employed under the conditions of use must be capable of etching chrome, examples of which are hydrofluoric acid, hydrochloric acid, phosphoric acid, and preferably sulfuric acid. Mixtures of acids can be used if desired. One particular advantage of the present invention is that the present invention makes it possible to provide an etchant composition for chromium which does not require hydrochloric acid. Also, preferably, the compositions of the present invention should be substantially, if not entirely, free from nitric acid since such tends to attack copper. Copper is present beneath the top chrome layer in the preferred articles treated by the compositions of the present invention.

The acid is present in the composition in amounts sufficient to etch the chrome. The amounts are usually about 1.5 to about 20% by weight of the aqueous composition. Preferred amounts of the acid are usually 8 to about 10% by weight of the aqueous composition. In addition, the amounts of acid present are such that the composition is acidic (i.e. $pH \leqq 2$). The pH of the aqueous etchant is generally about 0 to about 2, and preferably about 0 to about 1.

In addition, the compositions of the present invention must include thiourea or at least one substituted thiourea or mixtures thereof. Examples of some substituted thiourea compounds includes alkylthiourea compounds such as 1, 3-dimethylthiourea, 1, 3-diethylthiourea, 1, 3-diisopropylthiourea, and 1, 3-dibutylthiourea; allylthiourea; diphenylthiourea; and ethylenethiourea. The preferred compound employed is thiourea. The amount of the thiourea compound employed is usually about 1 to about 10% by weight, and preferably about 1 to about 3% by weight.

The compositions of the present invention are especially suitable for etching chrome and for selectively etching chrome layers without affecting underlying copper, if present, and without affecting positive photoresist materials and without significantly affecting the resistivity of the cermet which may also be present beneath the chrome. In addition, many negative photoresist materials are also resistant to the compositions of the present invention. The etching can be achieved by immersing the particular article to be etched in a bath of the composition and maintaining the material to be etched in contact with the composition for about 10 seconds to about 10 minutes, and preferably for about 10 seconds to about 1 minute.

The compositions of the present invention are employed generally at temperatures of about 50° C. up to about the boiling point of the compositions, and preferably no higher than about 90° C. The preferred temperatures are about 60° to about 80° C. The time and temperature of the etching are inversely related. That is, at the lower temperatures the longer immersion times of up to about 10 minutes are employed for etching away about 1000 Å of chromium. Also, the time is somewhat related to the amount or thickness of the material to be etched away.

A particular type of article treated according to the present invention includes a ceramic on top of which is a cermet, such as silicon monoxide cermet material, on top of which is a first layer of about 800 Å chromium, followed by a layer of about 80,000 Å of copper, followed by another 800 Å of chromium.

Examples of ceramic substrates include aluminum oxides, silicon oxides and aluminum silicate. An example of suitable cermet is obtained from firing a composition containing chrome and silicon monoxide.

The following nonlimiting example is presented to further illustrate the present invention.

EXAMPLE

An etch solution is prepared by dissolving about 50 ml. of concentrated sulphuric acid (i.e. about 98% concentration) and about 20 g. of thiourea in about 1 liter of water.

An aluminum oxide ceramic substrate having an 800 Å layer of chrome, on top of which is an 80,000 Å layer of copper, on top of which is another 800 Å layer of chrome is immersed in the above etch solution. The solution is at a temperature of about 60° C. The top chrome layer of 800 Å is etched away in about one minute. After a predetermined portion of the copper is etched away, preselected areas of bottom chrome layer are etched away. It is noted that there is only minimum undercutting of the top chromium during the etching of the bottom chromium layer and no appreciable change in the resistivity of the cermet material on the ceramic is observed.

We claim:

1. A method for etching chrome which comprises contacting the chrome with an acidic aqueous etchant composition containing water, an inorganic acid, and at least one thiourea compound selected from the group of thiourea, substituted thiourea, or mixtures thereof.

2. The method of claim 1 wherein only preselected areas of chrome are etched and those areas not to be etched are protected by a photoresist material.

3. The method of claim 2 wherein such photoresist material is a positive photoresist material.

4. The method of claim 1 wherein the contacting is carried out for about 10 seconds to about 10 minutes, and the temperature employed is about 50° to about 90° C.

5. The method of claim 1 wherein the acid is present in the amount of about 1.5 to about 20% by weight and the pH of the composition is about 2 or less.

6. The method of claim 1 wherein the acid is present in an amount of about 8 to about 10% by weight based upon the weight of the composition.

7. The method of claim 1 wherein the pH of the etchant is about 0 to about 2.

8. The method of claim 1 wherein the pH is of the etchant is about 0 to about 1.

9. The method of claim 1 wherein said acid is selected from the group of hydrofluoric acid, hydrochloric acid, phosphoric acid, sulphuric acid or mixtures thereof.

10. The method of claim 1 wherein said acid includes sulphuric acid.

11. The method of claim 1 wherein the amount of said thiourea compound is about 1 to about 10% by weight.

12. The method of claim 1 wherein the amount of said thiourea compound is about 1 to about 3% by weight.

13. The method of claim 1 wherein said thiourea compound includes thiourea.

14. The method of claim 13 wherein said acid includes sulphuric acid.

15. The method of claim 1 wherein the temperature is about 60° to about 80° C.

16. The method of claim 1 wherein said substituted thiourea compound is selected from the group of alkylthiourea compounds, phenylthiourea compounds or mixtures thereof.

17. The method of claim 2 wherein beneath the chrome being etched is copper.

18. The method of claim 2 or 17 wherein chrome circuitry lines for integrated circuit chips are etched.

19. The method of claim 1 wherein said composition consists essentially of water, about 8 to about 10% by weight of sulfuric acid, and about 1 to about 10% by weight of at least one thiourea compound selected from the group of thiourea, substituted thiourea, or mixtures thereof.

20. The method of claim 19 wherein said thiourea compound is thiourea.

21. The method of claim 19 wherein the amount of said thiourea compound is about 1 to about 3% by weight.

22. The method of claim 1 wherein said composition consists essentially of about 1.5 to about 20% by weight of an acid selected from the group of hydrofluoric acid, hydrochloric acid, phosphoric acid, sulphuric acid, or mixtures thereof, about 1 to about 10% by weight of at least one thiourea compound selected from the group of thiourea, substituted thiourea, or mixtures thereof; and wherein the pH of the composition is about 2 or less.

23. The method of claim 22 wherein said thiourea compound is thiourea.

* * * * *

UNITED STATES PATENT AND TRADEMARK OFFICE

CERTIFICATE OF CORRECTION

PATENT NO. : 4,370,197

DATED : January 25, 1983

INVENTOR(S) : Abolafia, et al.

It is certified that error appears in the above—identified patent and that said Letters Patent is hereby corrected as shown below:

On the title page, under "References Cited", please change patent number "3,636,123" to --- 3,686,123 ---.

Signed and Sealed this

*Twenty-second* Day of *March 1983*

[SEAL]

*Attest:*

GERALD J. MOSSINGHOFF

*Attesting Officer*

*Commissioner of Patents and Trademarks*